US009344797B2

(12) United States Patent
Peng

(10) Patent No.: US 9,344,797 B2
(45) Date of Patent: May 17, 2016

(54) MICROPHONE MODULE WITH AND METHOD FOR FEEDBACK SUPPRESSION

(71) Applicant: Yan Ru Peng, New Taipei (TW)

(72) Inventor: Yan Ru Peng, New Taipei (TW)

( * ) Notice: Subject to any disclaimer, the term of this patent is extended or adjusted under 35 U.S.C. 154(b) by 66 days.

(21) Appl. No.: 14/371,351

(22) PCT Filed: Jan. 7, 2013

(86) PCT No.: PCT/US2013/020591

§ 371 (c)(1),
(2) Date: Jul. 9, 2014

(87) PCT Pub. No.: WO2013/106292

PCT Pub. Date: Jul. 18, 2013

(65) Prior Publication Data

US 2015/0010165 A1 Jan. 8, 2015

(30) Foreign Application Priority Data

| | | |
|---|---|---|
| Jan. 9, 2012 | (TW) | 101100764 |
| Feb. 1, 2012 | (CN) | 2012 1 0022396 |
| Feb. 2, 2012 | (CN) | 2012 2 0032930 |

(51) Int. Cl.

| | |
|---|---|
| ***H04R 3/02*** | (2006.01) |
| ***H04R 1/08*** | (2006.01) |
| *H04R 1/04* | (2006.01) |
| *H04R 9/08* | (2006.01) |

(52) U.S. Cl.

CPC ..... *H04R 3/02* (2013.01); *H04R 1/086* (2013.01); *H04R 1/04* (2013.01); *H04R 9/08* (2013.01); *H04R 2410/03* (2013.01)

(58) Field of Classification Search
None
See application file for complete search history.

(56) References Cited

U.S. PATENT DOCUMENTS

| | | | | |
|---|---|---|---|---|
| 7,751,582 | B2 | 7/2010 | Akino | |
| 2006/0274913 | A1 | 12/2006 | Akino | |
| 2007/0237338 | A1* | 10/2007 | Konchitsky | H04M 1/035 381/91 |
| 2011/0200221 | A1 | 8/2011 | Akino | |
| 2011/0222718 | A1 | 9/2011 | Akino | |
| 2012/0014542 | A1 | 1/2012 | Akino | |
| 2015/0051439 | A1* | 2/2015 | Hillbratt | A61N 1/36032 600/25 |

FOREIGN PATENT DOCUMENTS

| | | | |
|---|---|---|---|
| CN | 101014214 | A | 8/2007 |
| JP | 05-323976 | A | 12/1993 |
| TW | 200822780 | A | 5/2008 |
| TW | I307247 | B | 3/2009 |

* cited by examiner

*Primary Examiner* — Andrew L Sniezek
(74) *Attorney, Agent, or Firm* — Novick, Kim & Lee, PLLC; Harold L. Novick

(57) ABSTRACT

A microphone module and method for suppressing feedback in a microphone. The module has a casing with a hollow bore therethrough and a microphone mounted in one end of the bore. The other end of the bore is completely covered by a film mounted onto the top of the casing. The film has at least one slit therethrough in the film portion that covers the other end of the bore. The method includes introducing a sound wave to a film having at least one slit therethrough that separates the film into at least two parts; generating a sound wave from each film part; and conveying the generated sound waves in a sound tube to a microphone as a rejoined sound wave.

12 Claims, 6 Drawing Sheets

MICROPHONE MODULE WITH AND METHOD FOR FEEDBACK SUPPRESSION

FIELD OF THE INVENTION

The present invention relates to microphones in general, and in specific, relates to microphones having feedback suppression.

BACKGROUND OF THE INVENTION

The audio feedback effect, also called microphone feedback, occurs when a sound wave enters a microphone having a frequency that is the same as the frequency of a sound wave at an output of the microphone.

Feedbacks could happen on the electronic equipment which receives and broadcasts sounds. When the External Feedback Path is formed, where sound waves generated by the broadcast point are received by the collecting point, sound waves are thus constantly repeatingly amplified.

There are 2 major impacts of feedbacks.

1. When feedback sounds are mixed with the original sounds, it would cause acoustic distortion.

2. When feedbacks of the same frequency repeatingly accumulate, and volume gain is too large, piercing whistles occur.

Cancellations in High Fidelity Acoustics:

(1) A microphone cannot determine whether the incoming sounds or signals are from an objective sound source or from noises, such as background noises or internal microphone generated noises. When objective sounds are interfered with by noises, their sound waves are changed, and thus the acoustic quality is affected.

(2) Traditional noise filters can solve this issue by treating the frequency of the incoming signals. If the noise and the sound source's frequencies are different, a high-pass filter (which allows only sounds below certain frequency to pass), a low-pass filter (which allows only sounds above certain frequency to pass), or a range-pass filter (which allows only sounds within certain frequency range to pass) can be used to filter out the noise.

(3) However if the noise and the objective sound's frequencies are the same, or are close (such as multiple reflections of the objective sound), the objective sounds and noises are similar, and the filter cannot delete the noise.

(4) In addition, irrespective of whether digital or analogue filters are used, or if frequency or time-domain filters are used, all are more-or-less subjected to mathematical transformations. The transformations result from distortion and time delay issues. Thus the better a filter is, the more complex design and mathematical conversions are required. For example the latest Wavelet filter could be used, but it is very expensive.

SUMMARY OF THE INVENTION

A major difference between an objective, desirable sound signals and noise signals are in their incoming direction and energy. Objective sounds have a fixed direction and a stronger energy. The noises that originate from other sources and their various directions usually have a weak energy. A purpose of the present invention is to cause the objective sound signals to predominate over the noise signals.

The present invention provides a mechanical solution to the feedback problem by shifting the phase of the input sound wave to the microphone. The phase shifting is done physically by separating the sound wave into at least two secondary waves and then re-combining them before they are impact on the microphone.

A microphone module according to the present invention includes a body, an opening or area to receive sound waves, and a transducer diaphragm. The module also includes a film or diaphragm that extends over and is spaced from the sound wave receiving area of the microphone body. The film has at least one slit or cut through it which in one embodiment is located in a central portion of the film. The slit allows the sound wave to pass through it and results in the formation of at least two distinct acoustic waves, one generated by a film portion on each side of the slit.

The structure of the film slit of the present invention allows sound waves from the directly ahead with a stronger energy to pass, but adds a filter effect to cancel out or reduce the effect of sound waves from other directions or with lower energy. In this way, there is no or only a little variance for the objective/target sound source's wave, and accordingly the acoustic quality is increased.

DESCRIPTION OF THE PREFERRED EMBODIMENTS

With reference now to FIGS. 1-5, the present invention will be described with respect to a presently preferred embodiment in which like numerals designate like elements throughout the several views.

In describing an embodiment of the present invention, only diagrammatic representations will be used, at least because the present invention is subject to a large number of particular implementations, which those skilled in the art would recognize.

Now, with a particular reference to FIGS. 1, 2, 3 and 4, there is depicted a microphone module 100 which comprises a diagrammatically depicted microphone 110 and a housing, guide tube or casing 120. Microphone 110 can be, for example, a conventional condenser microphone.

Figure 1:
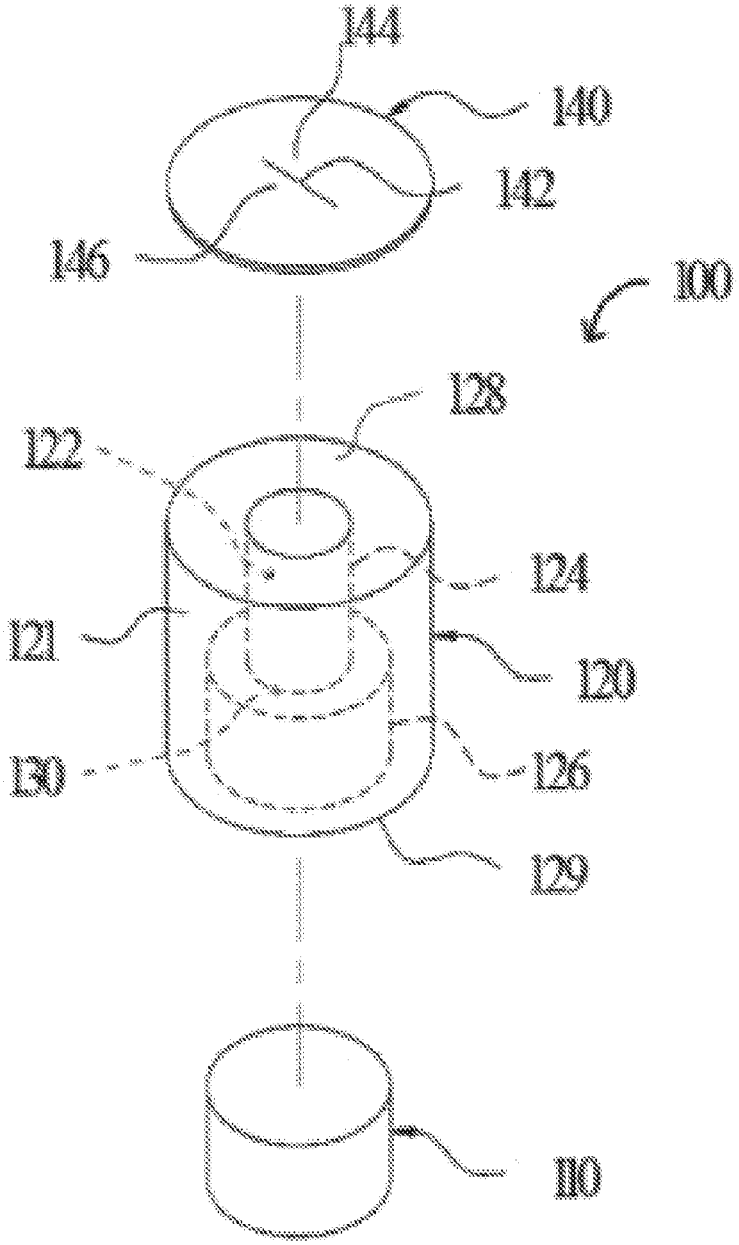
FIG. 1 is an exploded, perspective, diagrammatic view of a microphone according to a presently preferred embodiment having a casing with a top that has a slit therein.
Figure 3:
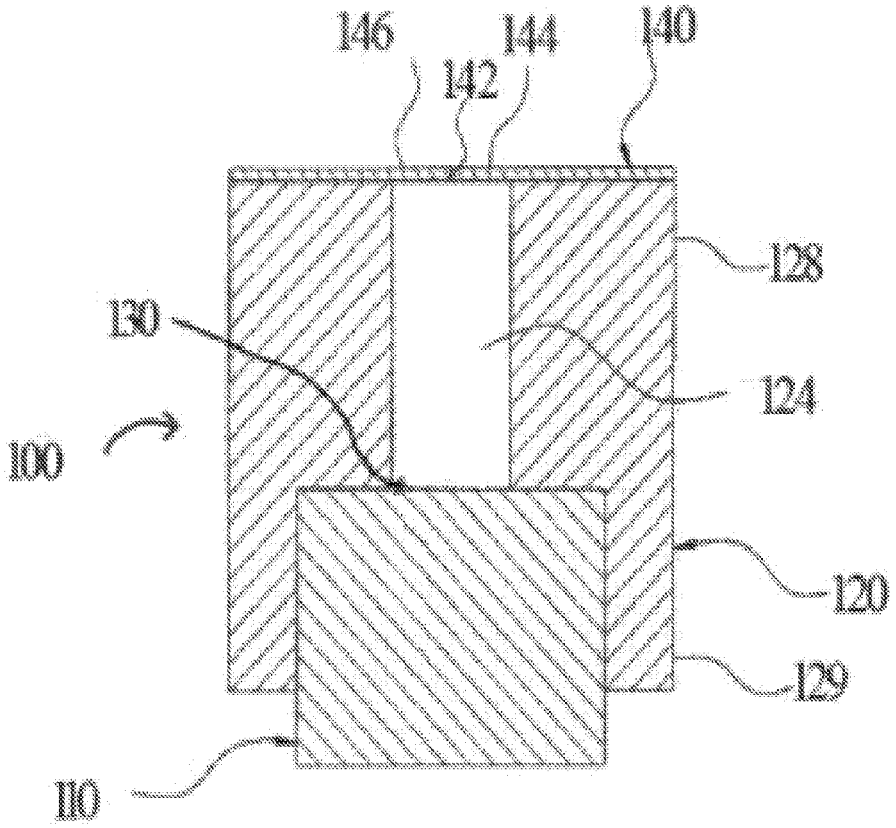
FIG. 3 is a cross sectional diagrammatic view taken along lines A-A of FIG. 2, of a microphone surrounded by the microphone casing and showing a top portion with a slit and the internal chamber.
Figure 4:
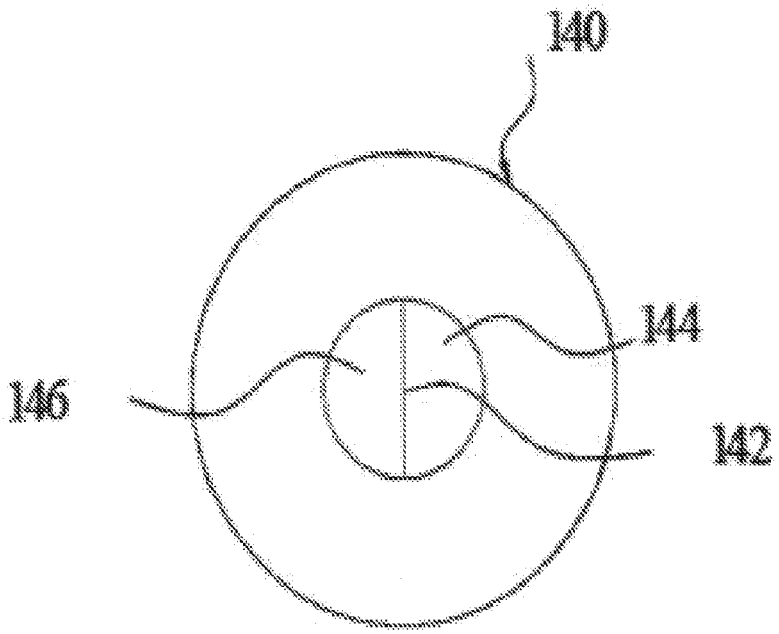
FIG. 4 is a top plan view of the microphone casing.

Guide tube 120 has an exterior surface 121 and an interior bore or chamber 122 extending completely there through. Chamber 122, as depicted in FIG. 1, has a longer, upper section 124 (sometimes called the first section so that the orientation of the chamber is not at issue) and a contiguous lower, wider section 126 (sometimes called the second section). Lower chamber section 126 has a diameter and bore configuration so as to be able to receive the top or sound receiving part of microphone 110, and to snuggly encompass microphone 110, as depicted in FIG. 3. The area where upper chamber section 124 and lower chamber section 126 meet, bottom 129 of upper chamber section 124, marks the end of the sound collecting space and thus its length. As discussed below, the length of upper chamber section 124 has an effect on the filtering characteristics and quality of microphone module 100.

Casing 120 as shown in FIG. 1 has a top audio receiving end 128 and a bottom end 130. The bottom audio transmitting end is depicted at 129, as mentioned above.

The interior shape of upper chamber 124 is depicted as being cylindrical, but it could be ovular or even rectangular. Although chamber 122 is depicted as having only one bore, casing 120 can be in more than one part and upper chamber 124 can be mounted directly to the end of microphone 110. Also, an outer elastic housing (not shown) can surround casing 120 so as to better isolate casing 120 from external sounds and vibrations.

Exemplary dimensions of casing 120, for two different embodiments are:

Microphone diameters (lower section 126): 9 mm and 6 mm;

Sound hole diameter of microphone: 4 mm and 2 mm;

Upper section 128 internal diameter: 4 mm and 2 mm; and

Upper section 128 length: 4 mm and 2 mm.

Figure 2:
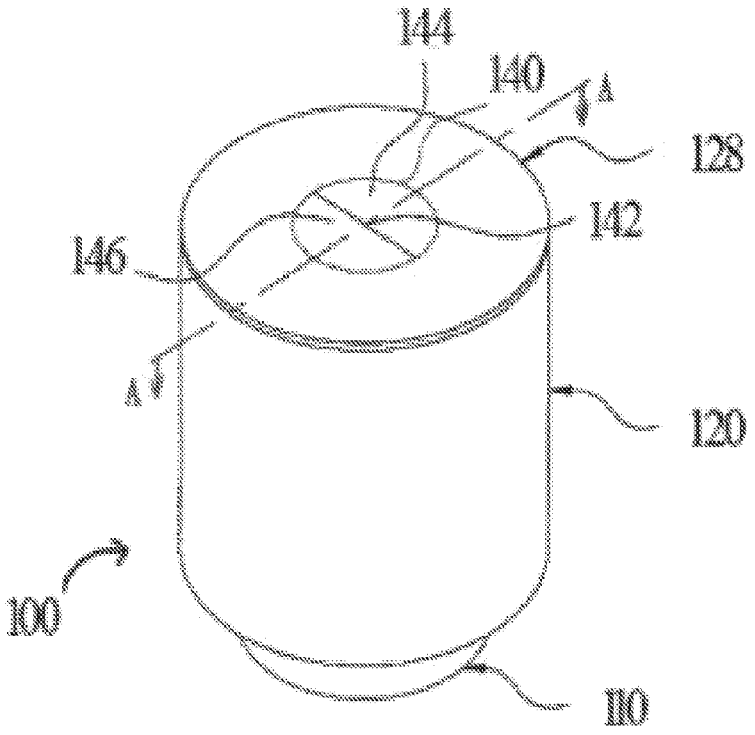
FIG. 2 is a perspective, diagrammatic view of the microphone casing showing the slit location.

Securely mounted on top end 128 of casing 120, such as by an adhesive or some mechanical connection such as a screw or nail, is a disk-shaped thin film 140. Film 140 has a minimum diameter so that it can completely close the upper end of chamber upper section 124 and is stretched tight across chamber 120. In FIGS. 1 and 2, film 140 has the same diameter as does the upper end of casing 120. In the present embodiment, film 140 is depicted and described as having only one sheet, but in other embodiments, film 140 could be comprised of a plurality of sheets or of a laminate having a plurality of layers.

Located in the central portion of film 140 is a single thin slit 142, which when film 140 is mounted on casing 120 fully extends across top end 128 of casing 120. Slit 142 divides film 140 into a first section 144 and a second section 146.

Film 140 can be made of any flexible, but unbreakable or untearable material, such as a plastic film (e.g. PET, PEEN and OPP). Also, film 140 can be comprised of a flexible and thin metallic film. Further, although film 140 is depicted as being comprised of a single material sheet, film 140 could also be comprised a multipart, multi material sheet in which the parts could be concentric, or could be coplanar with slit 142 dividing the different materials. Obviously, this later design provides different sound reproduction effects as the produced waves will have different qualities (e.g. phase, amplitude, vibration)

Film 140 has a thickness dimension in the range of about 0.01 mm to about 0.1 mm. The length of slit 142 can be as long as, or slightly longer than the diameter of the top of chamber 122 or it could be a length as short as one-half to nine-tenth the diameter of the top of chamber 122. Slit 142 is preferable a simple, thin cut.

Figure 6:
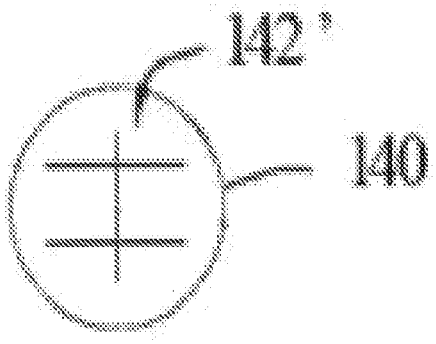
FIG. 6 is a plan view of a film showing a presently preferred split or cross cut pattern.

The length of slit 142 that is equal to or larger than the diameter of end of upper chamber section 124 is preferred. Preferably, slit 142 is straight or linear, but it could have an arcuate shape that if extended would have a radius of 100 s of millimeters to a few centimeters, somewhat depending upon the length of slit 142. Also, as discussed above, slit 142 can actually be multiple slits that preferably intersect, such as depicted in FIG. 6. Obviously, a more complex plurality of signals would be generated. Also, slit 142 can be comprised of a plurality of cuts that do not intersect, such as parallel cuts that result in a plurality of vibrating separate film sections. Further, in the embodiment in which there are plural films, such as two or more axially spaced apart films, each film can have a slit that is aligned and located above the other, or they can be in different parts of the film body so as not to be vertically aligned.

A slit 142 in a harder film 140, is presently preferred to comprise or have a cross shape, and a slit 142 in a softer film 140 is presently preferred to comprise a straight line slit or parallel slits.

Different locations of slit 142 with respect to the center of chamber upper section 124 has different results for piercing feedback suppression. If slit 142 is not in the center, there is a different size in first and second film sections 144 and 146 and a resultant different time shift of the sound wave. A slit 142 located in the center over chamber 122 is better than if it is not in the center of film 140. Thus for either a single slit 142, or for multiple slits, whether cross slits or parallel slits, the slits should be arranged symmetric to the center.

The diameter of film 140 is related to the size of the microphone, and should be slightly wider than the size range of the sound receiving hole or holes in the microphone body (on the top and sound collecting end). The thickness of film 140 will affect the result of sounds passing through film 140. When sounds are generated, high pitch sounds and low pitch sounds have the same level of energy. But as sounds spread away from the sound origin, high pitch sounds have more decay than the low pitch sounds. Thus when reaching a film 140 that is spaced from the sound origin, the low pitch sounds have more energy than the high pitch sounds. Thus, low pitch sounds are better able to pass (vibrate) a thicker film than high pitch sounds. Therefore, for the same film material, the thicker the film, the worse mid- and high-pitch sounds that would reach the microphone and that microphone design has a poorer performance at the mid- and high-pitch fields will not be good. For the same thickness of film, the softer the film material is, the better is the performance and results from mid- and high-pitch sounds. Films have a preferable thickness varying from 0.01 mm to 0.1 mm with material such as PET, PEEN and OPP. Various hardness of the film material is used to tune the microphone's performance for the desired result.

Casing 120 is preferably only a few centimeters long and a few centimeters in width. Although casing 120 is shown as a cylinder, any exterior shape can be utilized. Casing is preferably made of an elastic or soft material that is slightly compressible, but could also be made of a solid hard material, such as a plastic or metal. Casing 120 can also be comprised of a ceramic material that is resistant to cracking or breaking. Casing 120 can also be comprised of two or more materials, but it is preferably that the interior walls forming upper chamber 24 be non-resilient and be reflective so as not to introduce any interferences into the passing sound waves.

Similar as the ranges in the diameter of film 140 diameter, the length of chamber 122 affects the performance of microphone module 100 with various frequencies. If the length of chamber 122 is equal to or close to the inner diameter of chamber 122, there will be a good result for high, mid and low pitch sounds, and good piercing feedback suppression from the sound source and microphone. When the length of chamber 122 is smaller than the inner diameter thereof, there will be a better result for mid- and high-pitch sounds, but the feedback suppression of piercing sounds is worse (i.e. at a closer distance from the sound source to the microphone). When the length of chamber 122 is longer than the inner diameter thereof, there will be a worse result for mid- and high-pitch sounds, but the feedback suppression of piercing sounds is better (i.e. at a closer distance from sound source to the microphone).

Casing 120 can be made of a plastic, metal, ceramic material. The harder the material, the better are the isolation of possible vibrations from the casing material.

Figure 5:
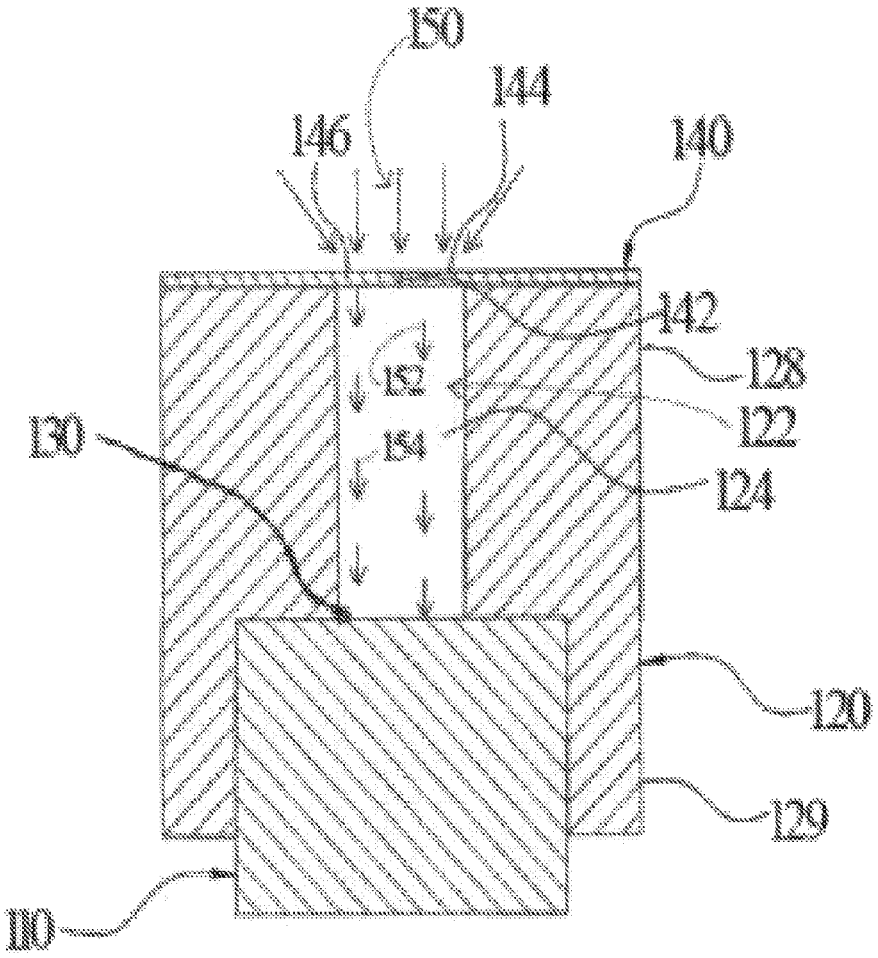
FIG. 5 is a diagrammatic cross sectional view showing schematically the division of an incident sound wave by the split in the film cover.

In the operation of microphone module 100, as depicted in FIG. 5, a sound wave 150 reaches the surface of film 140 and film sections 144 and 146 independently vibrate resulting in the generation of two sound waves, 152 and 154. Sound waves 152 and 154 have the same frequency and if film sections 144 and 146 have substantially the same surface area, will have the same phase, but the amplitude will be reduced to half. There can also a phase difference (i.e. a time difference) between original sound wave 150 and sound waves 152 and 154. Sound waves 152 and 154 pass through chamber 122 and are united and regenerated as a new sound wave at the bottom thereof. Due to the time difference between original sound wave 150 and generated sound waves 152 and 154, there are small differences between the new and the original sound waves, which is sufficient to suppress any feedback. Obviously, the greater the number of generated sound waves, such as by the slits in FIG. 6, the greater the cumulative differences will be between the original sound wave and the reconstituted sound wave, and the created the feedback suppression.

The present invention operates in theory as follows.

A. Noise Cancellation

Film 140 cancels feedback noises based on the following principles and reasons.

(1) Noises come from the reflections of the objective sound source, from non-objective sound sources and reflection from non-objective's sound source, and white noises (which in general refers to all multiple reflections, refractions, and dispersions at a sound source's surrounding).

(2) Orientation/Directional: Film 140 generates a large uni-directional effect, which filters out non-objective sound sources and white noises. Reflections of objective sound sources, non-objective sound sources, and white noises incident onto film 140 perpendicularly (i.e. in a normal direction) are not filtered.

(3) The critical energy which drives the film and the energy transformation of the above processes are not linearly transformed. The film vibrates only when the incident sound wave has minimum amount strength. For example, those noises which come from an objective sound source's reflection, non-objective sound source's reflection, and white noises which are reflected or multiply reflected have energy decay after transfers and spherical spreading. Thus these low energy noises are thus filtered by film 140.

(4) By using the structure of guide tube 120, a wind must pass through film 140 before reaching the microphone diaphragm. Thus wind pressure will not cause the microphone diaphragm to vibrate back and forth, but only to shift or move. Film 140 transfers sound energy by vibration. The shifting and movement of the film does not generate sound energy and thus noises because the energy is attenuated, absorbed, or reflected by the film.

(5) There are 2 conditions which could still result in the generation of sound from a wind striking film 140: the strength of the wind or the direction changes of the wind. When the wind's strength or direction changes, it changes the tightness of film 140, which could cause an effect that is similar to vibration. This is especially true when there are more severe changes in the wind's strength or directions, which is a situation more like vibrations. This type of noise is more serious.

When the wind blows toward the film 140 at a direction nearly parallel to the surface of film 140, the slight angle variation causes a large sound pressure variation, and generates noises. The power of the wind pressures is much larger than sound waves. Thus, a wind component with film 140 resulting in less than 5% energy can make film 140 vibrate, and generate noises. Thus, when a wind blows nearly parallel to film 140, there would be noises. (This phenomenon is similar to when wind flow a flag, the flag waves within small angles, and makes sounds.)

A physical method of lowering feedbacks for microphone by using films has been described for various types of sound waves impacting on microphone module 100. There is an elastic film at the input end of the microphone, and there is at least one cut in the film, as shown in FIGS. 1 and 2. Sound waves are energy that is transmitted by directional vibrations. A perpendicular component to film 140 makes film 140 vibrate and a parallel component does not. When film 140 is not cut film 140 is sealed tight and it is hard to make a contribution to the vibrations. Only small portion of can pass through film 140 and forms a penetrating wave while the rest is reflected and forms a perpendicular reflex wave.

When film 140 is cut, the opening edges are free ends and the resulting film portions can easily vibrate, and form penetrating waves. When the generated sound waves reach microphone 110, and are collected by microphone 110, there is a time difference, but the time difference is small, and the distortion is usually acceptable. When there is no film 140, as in traditional microphone, at the opening of the sound collecting end, though the incident wave comes parallel to the opening, some sound waves will enter the sound collecting end due to the diffraction effect. Thus certain sounds are still collected, and it is possible to totally block out the sounds.

When there is no film, as in a the traditional microphone, at the opening of the sound collecting end, sound waves enter the sound collect opening in the transmission path which is not parallel with the sound collecting tube. There would be multiple reflections and other disturbances occur on the tube's wall. Various frequencies of reflections will cause various disturbances, and cause sound distortions.

The invention's structure employs one or more films, but for the purpose of the following explanation, only a single film will be discussed. With respect to a film and its vibrations, sound waves enter the tube in the transmitting path which is nearly parallel to the tube's wall, produces less multiple reflections, thus there are no sound distortions.

When sound waves from a sound source comes at an incident angle "theta" to the surface of film 140, its sound wave arrives film A and B at difference time, and the 2 films vibrate independently. They could be seen as 2 new sound waves (see FIG. 5), which have the same wave form with but half amplitude of the sound source, and there is the time difference and phase difference between the two new sound waves. The 2 new waves combine as one sound wave in inner chamber 122. Because of the phase difference between the 2 sound waves, there is a slight difference between the new formed sound wave and the source's sound wave. The new formed sound wave is collected by the microphone, and outputted from the speaker. When the outputted sound wave returns to film 140, the new wave arrives with a time difference from the original wave, and again new sound wave is formed in the tube with phase. And the accumulated phase difference increases, With the present invention, each time the wave feedbacks, it accumulates phase differences, and decreases the accumulation results, thus suppressing the feedback noises or whistles. For microphone feedback from microphones not employing the present invention, theoretically, the more times sound waves with same frequencies at zero phase difference feedback, the stronger will be the piercing whistles. However, with the present invention, the more times sound waves feedback, the phase difference increases, the accumulated difference of the wave form increases, thereby increasingly suppressing the piercing whistles.

Other embodiments, alternatives, modifications, variations to the presently disclosed embodiments, as well as other dimensions, are obvious to those skilled in the art, and the scope of the present invention is determined by the attached claims.

I claim:

1. A microphone module comprising a microphone having a sound receiving portion;

a casing having a chamber therein with at least one end open, said microphone mounted in said chamber such that at least a portion of said chamber extends beyond said sound receiving portion; and a film completely covering said open end of said chamber, said film having at least one slit therein in a portion of said film that is located over said chamber open end, said slit extending completely through said film thereby separating said film into a first vibrating portion and a second vibrating portion when a sound wave strikes said film.

2. The microphone module as claimed in claim 1 wherein said chamber extends completely through said casing.

3. The microphone module as claimed in claim 1 wherein said chamber has a first section with an open end and a second section contiguous with said first section, said microphone being mounted in said second section.

4. The microphone module as claimed in claim 3 wherein said opening of said casing chamber is about 2.0 mm in diameter.

5. The microphone module as claimed in claim 3 wherein said chamber first section has a cylindrical shape.

6. The microphone module as claimed in claim 1 wherein said slit is located in the center portion of that part of said film that covers said chamber open end.

7. The microphone module as claimed in claim 1 wherein said film has a plurality of intersecting slits, each slit extending completely through said film and dividing said film into corresponding vibrating portions when a sound wave strikes said film.

8. The microphone module as claimed in claim 1 wherein said film has a thickness from about 0.01 mm to about 0.1 mm.

9. The microphone module as claimed in claim 1 wherein said casing is elastic.

10. The microphone module as claimed in claim 1 wherein said microphone is a condenser microphone.

11. A method of suppressing feedback in a microphone comprising:

introducing a sound wave to a film having a slit therein such that said sound causes each of the sides of the slit to vibrate separately so as to produce two sound waves;

conducting the two sound waves through a sound tube to a microphone mounted in a casing; and permitting the two sound waves to recombine.

12. A method of suppressing feedback in microphones as claimed in claim 11, and further comprising providing said microphone in said casing having a chamber for tightly receiving said microphone;

providing the sound tube in said casing so as to extend from said microphone in said casing to a top of said casing;

providing said film on the top of said casing, said film having at least one slit in said film that extends completely through said film to divide said film into at least two portions; and introducing sound waves to said film so as to cause said film portions to vibrate and produce the two sound waves, and permitting the two sound waves to recombine in said sound tube before impinging on said microphone.

* * * * *